US007722513B2

(12) United States Patent
Habing

(10) Patent No.: US 7,722,513 B2
(45) Date of Patent: May 25, 2010

(54) DUAL BACK PAD TILTING MECHANISM

(75) Inventor: Theodore G Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 0 days.

(21) Appl. No.: 11/372,590

(22) Filed: Mar. 10, 2006

(65) Prior Publication Data

US 2007/0213185 A1 Sep. 13, 2007

(51) Int. Cl.
*A63B 26/00* (2006.01)
*A63B 71/00* (2006.01)

(52) U.S. Cl. ..... 482/142; 482/139

(58) Field of Classification Search ..... 482/142, 482/134, 908, 104, 100, 139; 297/357; 248/292.14
See application file for complete search history.

(56) References Cited

U.S. PATENT DOCUMENTS 4,635,934 A * 1/1987 Roethke ..... 482/104
4,720,099 A * 1/1988 Carlson ..... 482/133
4,730,829 A * 3/1988 Carlson ..... 482/5
4,749,190 A * 6/1988 Jennings ..... 482/104
4,844,456 A 7/1989 Habing et al.
4,936,572 A * 6/1990 Desiderio ..... 482/142
5,044,631 A * 9/1991 Jones ..... 482/138
5,082,259 A 1/1992 Gonzalez
5,342,270 A * 8/1994 Jones ..... 482/98
5,350,346 A * 9/1994 Martinez ..... 482/142
5,370,595 A * 12/1994 Voris et al. ..... 482/100
5,454,773 A * 10/1995 Blanchard et al. ..... 482/133
5,603,682 A 2/1997 Grider
5,616,107 A * 4/1997 Simonson ..... 482/97
5,688,216 A * 11/1997 Mauriello ..... 482/135
5,906,566 A * 5/1999 Whitcomb ..... 482/130
6,251,052 B1 * 6/2001 Simonson ..... 482/100
6,283,900 B1 * 9/2001 Tornabene ..... 482/122
6,371,896 B1 * 4/2002 Kettler ..... 482/142
6,394,938 B1 * 5/2002 Tornabene ..... 482/142
6,471,624 B1 * 10/2002 Voris ..... 482/142
6,605,023 B1 * 8/2003 Mobley ..... 482/142
6,656,095 B2 * 12/2003 Fernandez ..... 482/142
6,685,601 B1 * 2/2004 Knapp ..... 482/104
6,860,840 B2 * 3/2005 Carter ..... 482/97
6,971,977 B1 * 12/2005 Chen ..... 482/140
7,108,639 B2 * 9/2006 Smith et al. ..... 482/72
7,128,702 B2 * 10/2006 Boland et al. ..... 482/142
7,147,287 B2 * 12/2006 Kuivala ..... 297/344.14
7,220,221 B2 * 5/2007 Mosimann et al. ..... 482/100

OTHER PUBLICATIONS

IMPEX Exercise Machine (date unknown).
Task Industries Machine (Tuff Stuff). 2005.

* cited by examiner

*Primary Examiner*—Loan H Thanh
*Assistant Examiner*—Sundhara M Ganesan
(74) *Attorney, Agent, or Firm*—Blakely, Sokoloff, Taylor & Zafman LLP

(57) ABSTRACT

An adjustment mechanism for a back support cushion of an exercise machine has two separate pivotal adjustments. One pivot is located above and behind the back support cushion and a second is located below and behind the back support cushion. A two-arm linkage system connects the back support cushion to the exercise machine at the two pivot locations.

22 Claims, 2 Drawing Sheets

DUAL BACK PAD TILTING MECHANISM

BACKGROUND OF THE INVENTION

1. Field of the Invention

This invention relates to the field of exercise equipment and, more particularly, to a mechanism for adjusting the tilt angle of a back support cushion of a multi-purpose exercise machine.

2. Background

Exercise machines for performing a variety of different exercises have become widely popular. Such multi-purpose or multi-station exercise machines are relatively compact, but permit exercises to be performed that involve virtually all of the major muscle groups of the body. Such machines typically have a single seat from which many of the exercises are performed. The seat generally comprises separate seat and back cushions, each of which may be adjustable to accommodate different physiques and to more effectively position the body for the various exercises.

The back support cushion, which may also be used a chest support cushion for certain exercises, typically requires a broad range of adjustment. Prior art exercise machines have employed a variety of adjustments for back support cushions. These include telescoping adjustment; a single pivot below and behind the cushion as shown, for example, in U.S. Pat. No. 4,448,456; a single pivot adjustment below and behind the cushion with a loose swivel pivot at the top of the cushion; and a slotted adjustment as shown, for example, in U.S. Pat. No. 5,603,682. Prior art single pivot adjustments do not provide sufficient adjustment of the back support cushion for a leg extension exercise. The range of adjustment is inherently limited by the nature of the single pivot adjustment mechanism. Back support cushions with telescopic adjustments are more difficult to adjust because of friction and have more slop in the adjustment. A slotted adjustment, such as shown in the '682 patent, is cumbersome to adjust since the entire back support cushion must be dislodged from one slot position and moved into another.

SUMMARY OF THE INVENTION

The present invention provides an adjustment mechanism for a back support cushion with two separate pivotal adjustments. One pivot is located above and behind the back support cushion and a second is located below and behind the back support cushion. A two-arm linkage system connects the back support cushion to the exercise machine at the two pivot locations.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
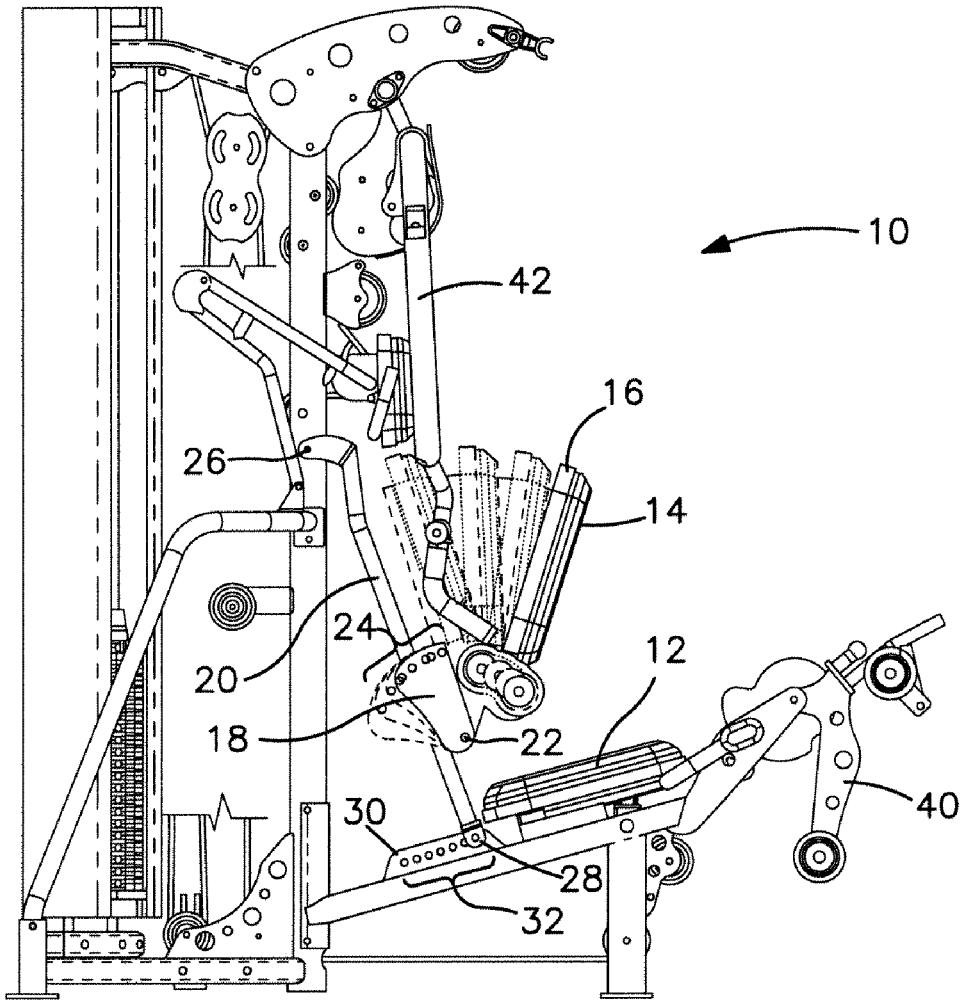
FIG. 1 is a side elevation view of a multi-purpose exercise machine incorporating the present invention.
Figure 2:
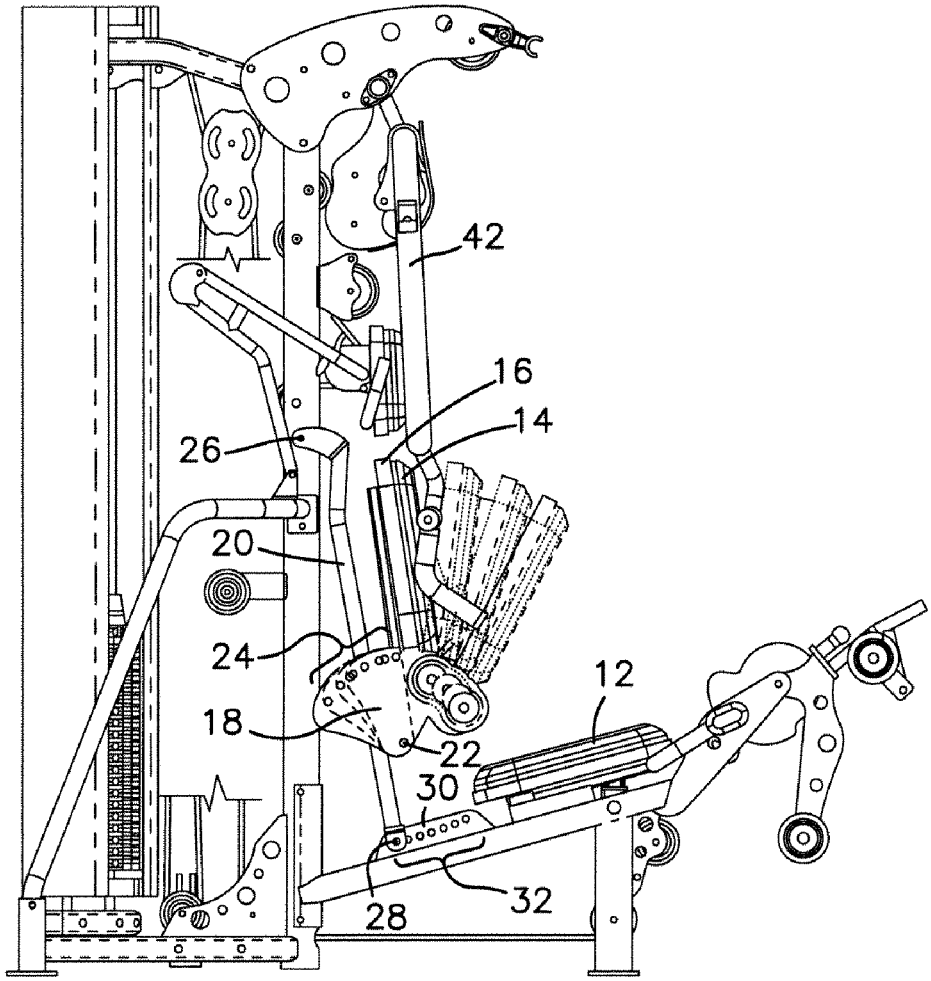
FIG. 2 is another side elevation view of the exercise machine shown in FIG. 1 illustrating further adjustment of the back support cushion.

FIGS. 1 and 2 are side elevation views of a multi-purpose exercise machine 10. Most of the various exercises that may be performed are done with the operator seated on seat cushion 12 and with the operator's back positioned against back support cushion 14. The back support cushion is attached to a rigid frame member 16, which is attached to sector plate 18. The back support assembly comprising cushion 14, frame member 16 and sector plate 18 are pivotally coupled to support member 20 at pivot 22. Sector plate 18 has a plurality of holes 24 so that the position of the back support cushion relative to support member 20 may be set as desired by the operator inserting a pin (not shown) through a selected one of holes 24 and into a hole in support member 20. The pin for securing the sector plate in a desired position is preferably a spring-loaded pin within a housing attached to support member 20 (on the side out of view in FIGS. 1 and 2). Such pins are widely used in the design of exercise equipment.

Support member 20 is pivotally coupled to the frame of exercise machine 10 at pivot 26. The lower end 28 of support member 20 is positioned along frame member 30, which has a plurality of holes 32. Support member 20 may be set at a desired position by the operator inserting a pin (not shown) through a hole in the lower end 28 and through a selected one of the holes 32. Here, again, the pin is preferably a spring-loaded pin of the type described above.

The dual pivotal adjustments for back support cushion 14 allow for a variety of positions, both longitudinally and with different angles of recline. Adjustment of the cushion about pivot 26, which is above and behind the cushion, primarily provides longitudinal adjustment of the cushion for exercises performed with the leg station 40 and press/row arm 42. FIG. 1 shows the position of support arm 20 adjusted to provide the most forward position of cushion 14, whereas FIG. 2 shows support arm 20 adjusted to provide the most rearward position of the cushion.

Adjustment of the back support cushion about pivot 22, which is below and behind the cushion, primarily provides adjustment of the angle of recline of the cushion for various shoulder, incline and press exercises. The combination of the two pivotal adjustments provides full longitudinal adjustment for comfortable chest support in a seated row exercise and provides numerous varied positions for back and chest positions of any exercise associated with cushion 14.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise apparatus, comprising:

a frame;

an exercise station having a seat cushion and a back pad, the back pad pivotally positionable about a first pivot;

a support member carrying the first pivot, the support member pivotally positionable about a second pivot fixed on the frame;

wherein a portion of the back pad proximate to the seat cushion is longitudinally positionable with respect to the frame independent of the seat cushion by adjustment of the support member about the second pivot;

a first locking mechanism to secure the support member at a desired angle with respect to the second pivot;

wherein the back pad is pivotally positionable about the first pivot without releasing the first locking mechanism;

a second locking mechanism, separate from the first locking mechanism, to secure the back pad at a desired angle with respect to the first pivot.

2. The apparatus of claim 1 wherein the exercise station comprises a leg extension arm.

3. The apparatus of claim 1 wherein the exercise station comprises a press/row arm.

4. The apparatus of claim 1 wherein the exercise station comprises a lat pull.

5. The apparatus of claim 1 wherein the exercise station comprises a mid pulley station.

6. A user support for an exercise machine comprising:

a seat cushion;

a back support subframe pivotally coupled to a frame member of the exercise machine at a first pivot, the subframe selectively positionable at a plurality of inclination angles with respect to the first pivot;

a back support cushion pivotally coupled to the subframe at a second pivot, the cushion selectively positionable at a plurality of inclination angles with respect to the second pivot;

wherein a portion of the back support cushion proximate to the seat cushion is longitudinally positionable with respect to the frame member independent of the seat cushion by adjustment of the support member about the first pivot;

a first locking mechanism to secure the subframe at a desired angle with respect to the first pivot;

wherein the back support cushion is pivotally positionable about the second pivot without releasing the first locking mechanism;

a second locking mechanism, separate from the first locking mechanism, to secure the back support cushion at a desired inclination angle with respect to the second pivot.

7. The user support of claim 6 wherein the first pivot is located above the back support cushion.

8. The user support of claim 6 wherein the second pivot is located below the back support cushion.

9. The user support of claim 6 wherein the exercise machine includes a leg extension arm operable by a person supported by the back support.

10. The user support of claim 6 wherein the exercise machine includes a press/row arm operable by a person supported by the back support.

11. The user support of claim 6 wherein the exercise machine includes a lat pull station operable by a person supported by the back support.

12. The user support of claim 6 wherein the exercise machine includes a mid pulley station operable by a person supported by the back support.

13. An exercise apparatus, comprising:

a frame;

an exercise station having a back pad and a seat pad, the back pad coupled to the frame such that a portion of the back pad proximate to the seat cushion is longitudinally positionable with respect to the frame independent of the seat pad, the back pad pivotally adjustable about a first pivot;

a support member carrying the first pivot, the support member pivotally adjustable about a second pivot fixed on the frame;

a first locking mechanism to secure the support member at a desired angle with respect to the second pivot, wherein the back pad is pivotally adjustable about the first pivot without releasing the first locking mechanism;

a second locking mechanism, separate from the first locking mechanism, to secure the back pad at a desired angle with respect to the first pivot.

14. The apparatus of claim 13 including at least one locking mechanism to lock the back pad and the support member in a plurality of positions.

15. The apparatus of claim 13 wherein the back pad is pivotally adjustable about the first pivot independent of the second pivot.

16. The apparatus of claim 13 wherein adjustment of the support member about the second pivot results in primarily longitudinal movement of the back pad adjacent to the first pivot.

17. The apparatus of claim 13 wherein the exercise station comprises a leg extension arm pivotally coupled to the frame.

18. The apparatus of claim 13 wherein the exercise station comprises a press/row arm.

19. The apparatus of claim 13 wherein the exercise station comprises a lat pull.

20. The apparatus of claim 13 wherein the exercise station comprises a mid pulley station.

21. The apparatus of claim 17 wherein adjustment of the support member about the second pivot moves a portion of the back pad toward the leg extension pivot.

22. The apparatus of claim 13 wherein adjustment of the first or second pivot provides longitudinal movement of a portion of the back pad.

* * * * *